US010034593B2

(12) United States Patent
Stewart

(10) Patent No.: US 10,034,593 B2
(45) Date of Patent: Jul. 31, 2018

(54) BROOM STICK AND MOP ADAPTER APPARATUS

(71) Applicant: Corey James Stewart, Langley (CA)

(72) Inventor: Corey James Stewart, Langley (CA)

( * ) Notice: Subject to any disclaimer, the term of this patent is extended or adjusted under 35 U.S.C. 154(b) by 0 days.

(21) Appl. No.: 15/419,750

(22) Filed: Jan. 30, 2017

(65) Prior Publication Data

US 2017/0238783 A1 Aug. 24, 2017

(51) Int. Cl.

| | |
|---|---|
| ***A47L 13/12*** | (2006.01) |
| ***A47L 13/256*** | (2006.01) |
| ***A47L 13/52*** | (2006.01) |
| ***A46B 5/00*** | (2006.01) |

(52) U.S. Cl.

CPC ..... *A47L 13/256* (2013.01); *A46B 5/0095* (2013.01); *A47L 13/12* (2013.01); *A47L 13/52* (2013.01); *A46B 2200/302* (2013.01)

(58) Field of Classification Search

CPC ..... A47L 13/256; A47L 13/52; A47L 13/12; A46B 5/0095; A46B 2200/302

See application file for complete search history.

(56) References Cited

U.S. PATENT DOCUMENTS

| | | | | | |
|---|---|---|---|---|---|
| 399,223 | A * | 3/1889 | Varney | A47L 13/12 | 15/115 |
| 502,000 | A * | 7/1893 | Giles | A46B 9/005 | 15/115 |
| 1,563,829 | A * | 12/1925 | Brown | A47L 13/294 | 15/114 |
| 4,852,210 | A * | 8/1989 | Krajicek | A47L 13/20 | 15/144.2 |
| 2004/0071490 | A1* | 4/2004 | Vosbikian | A47L 13/12 | 401/49 |
| 2005/0011536 | A1* | 1/2005 | Hofte | A47L 13/10 | 134/6 |
| 2014/0334125 | A1* | 11/2014 | Yao | G02B 6/0055 | 362/23.03 |

* cited by examiner

*Primary Examiner* — Randall Chin
(74) *Attorney, Agent, or Firm* — Nexus Law Group LLP

(57) ABSTRACT

Provided is a combination broom and cleaning fabric adapter apparatus. The apparatus may include a planar plate having a first and a second surface. The plate may be configured to position a cleaning fabric on the first surface. The first surface may include grippers to grip the cleaning fabric onto the first surface. A stick attachment device may be connected to the second surface for attaching a standard broom or mop stick to the plate at a first location on the plate. The stick attachment device may be configured to allow the stick to pivot freely in two-dimensions relative to the plate. A broom brush attachment device may be connected to the second surface adjacent an edge of the plate for attaching a broom brush to the plate.

13 Claims, 4 Drawing Sheets

BROOM STICK AND MOP ADAPTER APPARATUS

FIELD OF THE INVENTION

The invention relates to the field of cleaning apparatuses and in particular, to an adapter apparatus that accommodates a standard broom head, stick and mop cleaning fabric.

BACKGROUND OF THE INVENTION

With current floor cleaning tools, it is customary to employ both a broom with a dustpan, and a separate mop. Other options include newer products such as the Swiffer™ brand of cleaning tools, and past tools such as cloths; both regular fiber and micro fiber. The problem with standard mops is their tendency to move dirt around rather than removing it from the floors. Swiffers™ are useful in certain applications, but they cannot remove larger bits of dirt and debris from the floor and are limited to removing dust and small pieces of dirt. By far the best way to wash your floors is to first sweep the floor and then get down on your hands and knees to use a hand cloth to further clean the floor. Further problems with today's cleaning tools are their need for costly attachments, cleaning liquids and related items which are often filled with harmful chemicals.

Accordingly, a need exists for an easy to use and cost effective cleaning tool that overcomes the problems with today's tools. Other objects of the invention will be apparent from the description that follows.

SUMMARY OF THE INVENTION

The invention provides an adapter plate whereby a standard broom and mop can be combined into a single cleaning tool, eliminating the need to carry around both tools separately. The invention will allow various machine washable cleaning attachments to be attached thereto. Conventional techniques require a person to first sweep the floor with a separate broom and then mop the floor with a separate mop in order to get the floor clean. The present invention seeks to eliminate the need to cumbrously carry around both tools in order to properly clean a floor.

According to the present invention there is provided a combination broom and cleaning fabric adapter apparatus. The apparatus may include a planar plate having a first and a second surface. The plate may be configured to position a cleaning fabric on the first surface. The first surface may include grippers, such as a Velcro™ strip, to grip the cleaning fabric onto the first surface. A stick attachment device may be connected to the second surface for attaching a standard broom or mop stick to the plate at a first location on the plate. The stick attachment device may be configured to allow the stick to pivot freely in two-dimensions relative to the plate. A broom brush attachment device may be connected to the second surface adjacent an edge of the plate for attaching a broom brush to the plate.

The stick attachment device may include a stick receiver to receive the stick at a first end and a socket connected to the second surface. The stick receiver may include a ball joint at a second end configured to fit into the socket. Alternatively, the stick attachment device may include a stick receiver to receive the stick at a first end and a universal joint connected to the second surface. The universal joint may be configured to attach with the stick receiver at the stick receiver's second end. In each embodiment, the stick receiver at the first end may be configured to threadedly receive the stick.

The broom brush attachment device may include a brush receiver to receive the broom brush and a brush receiver connector connected to the second surface and to the brush receiver. The brush receiver may be a threaded plug having a first and a second end; the first end may be configured to thread into the broom brush. The brush receiver connector may be a collar configured to threadedly connect to the second end of the brush receiver.

The plate may also include locking device connected to the second surface at a second location on the plate. The locking device may be in linear alignment with the stick attachment device for locking the stick to the plate. The locking device may be a flexible c-clamp configured to receive the stick.

Optionally, the adapter apparatus may also include a dust pan shaped to cover the plate and it may be configured to attach to the stick.

Other aspects of the invention will be appreciated by reference to the detailed description of the preferred embodiment and to the claims that follow.

BRIEF DESCRIPTION OF THE DRAWINGS

The preferred embodiment of the invention will be described by reference to the drawings thereof in which.

DESCRIPTION OF THE PREFERRED EMBODIMENT OF THE INVENTION

Figure 1:
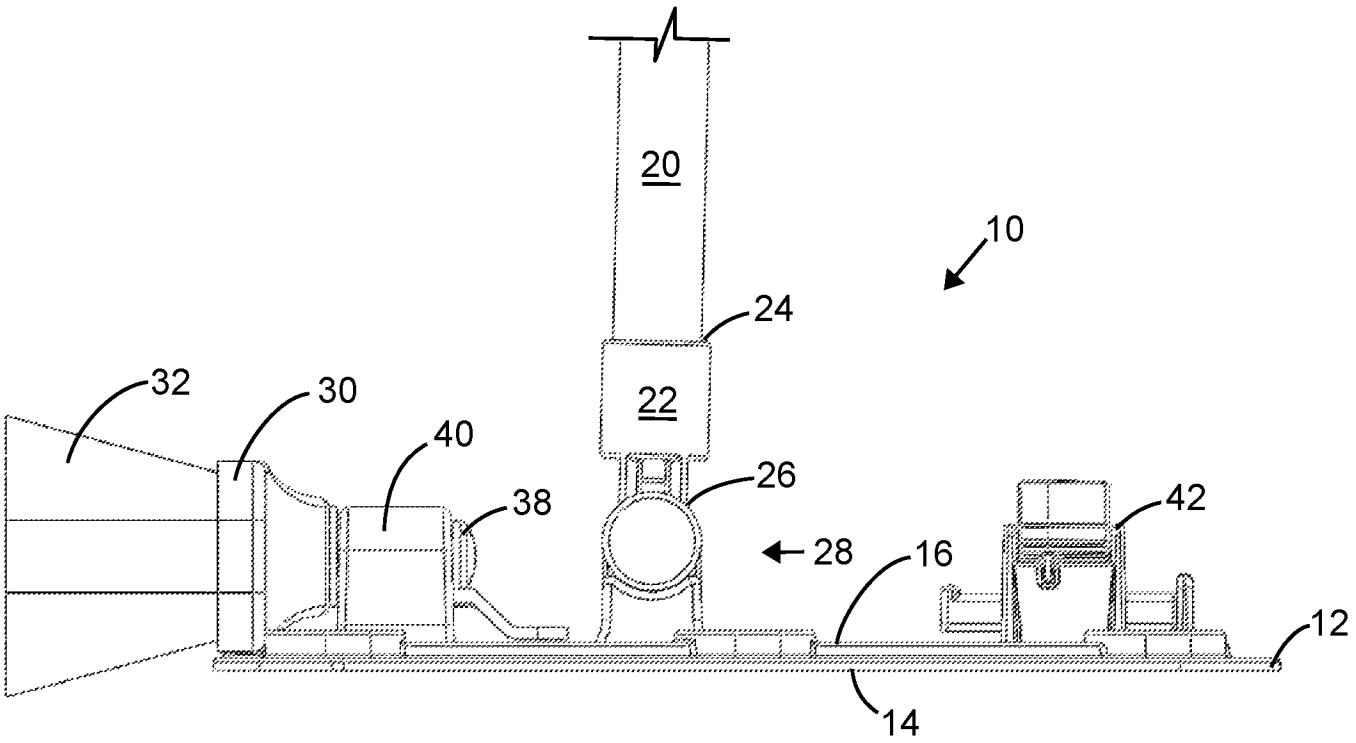
FIG. 1 is a side elevation of the invention with a broom stick and broom brush attached thereto.
Figure 2:
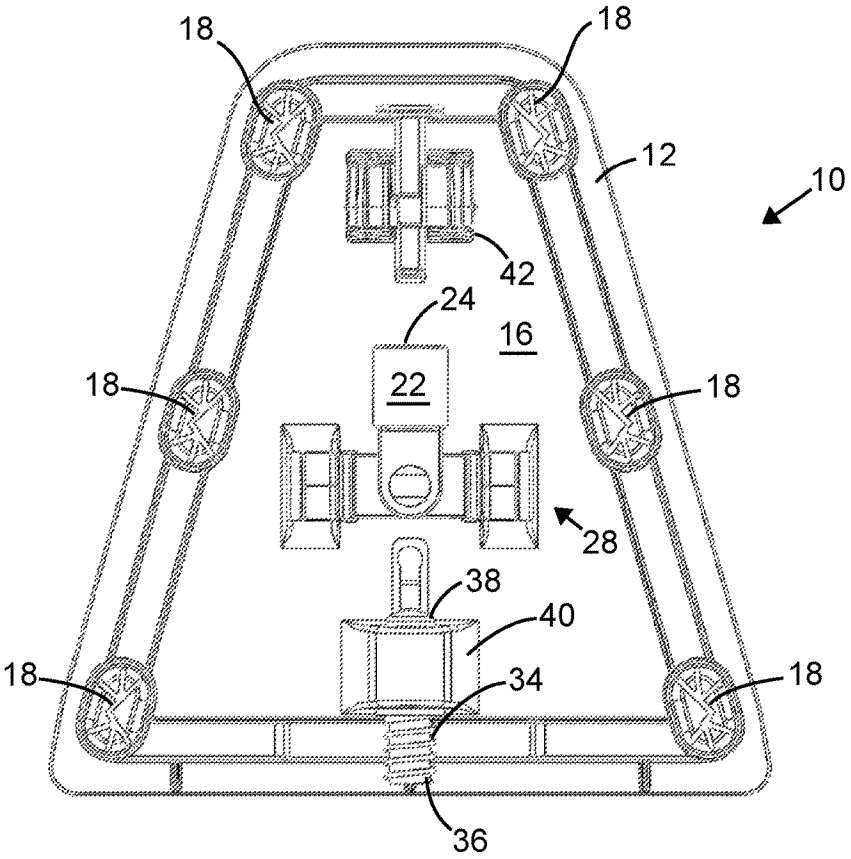
FIG. 2 is a top plan view of the invention.
Figure 3:
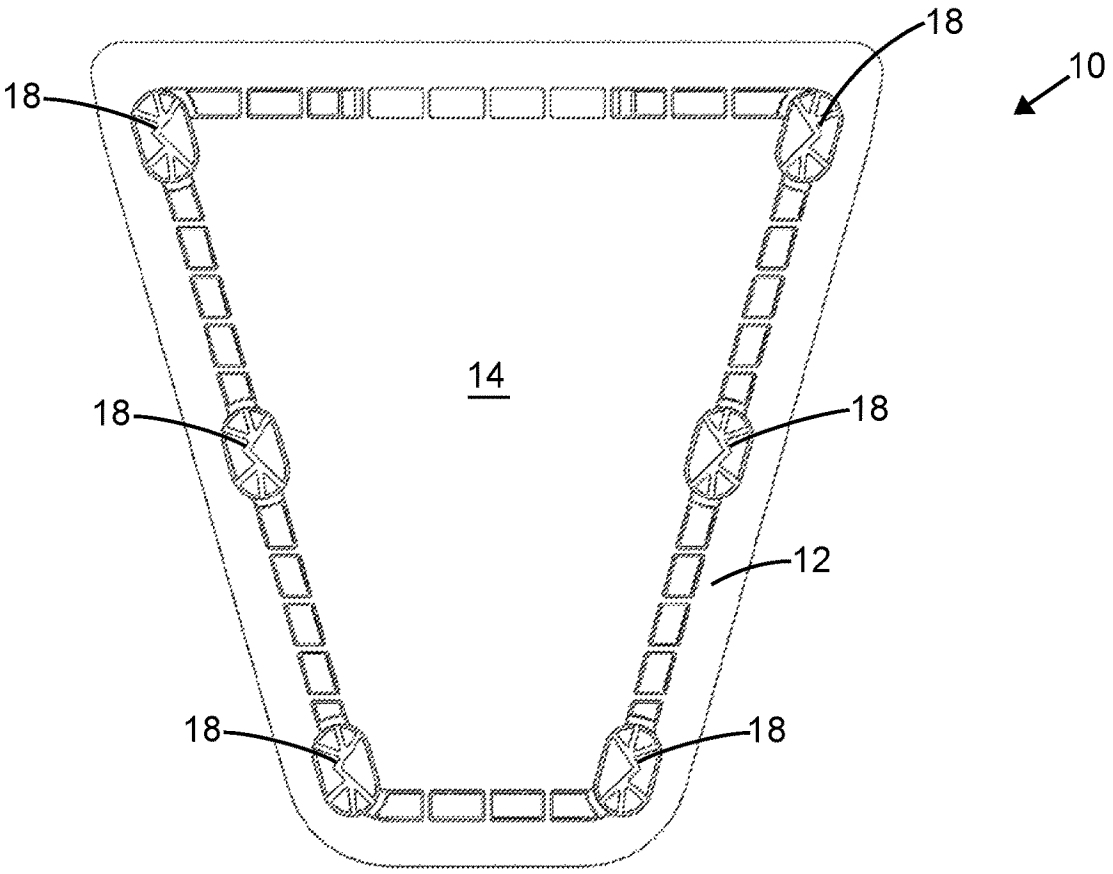
FIG. 3 is a bottom plan view of the invention.

Referring to FIGS. 1 to 3, a combination broom and cleaning fabric adapter apparatus 10 is depicted. Adapter apparatus 10 includes a planar plate 12 having a first 14 and a second surface 16. Plate 12 is preferably trapezoidal in shape as depicted, but its shape may take on any suitable form. Plate 12 is preferably made from plastic in order to keep costs and weight to a minimum, but any material may be suitable in its construction.

First surface 14 is generally held towards the floor while the plate 12 is used in its mop configuration. The plate 12 is configured to position a cleaning fabric on the first surface 14. The cleaning fabric may be any conventional fabric such as a Swiffer™ pad or other like material, including conventional mop strips or strings. Velcro™ strips may be applied to the first surface 14 and to the fabric to position the fabric onto the first surface. Preferably, first surface 14 includes grippers 18 to grip the cleaning fabric onto the first surface. Grippers 18 are preferably placed near the edges of plate 12 so that the user can stretch the fabric across the first surface 14 to prevent bunching of the fabric. As depicted, plate 12 is relatively thin. In this case, grippers 18 may extend from the first surface 14 to the second surface 16. Here advantageously, the user may pull the fabric through the plate 12 to further tighten the fabric to the first surface. Grippers 18 are preferably cutouts from plate 12. Being cut from the plate 12, grippers 18 are flexible enough to allow the user to push or pull the fabric through the grippers.

To attach a conventional broom or mop stick 20 to the plate 12, a stick attachment device is connected to the second surface 16. To balance the plate 12 and to even the forces applied to the plate while in use, the attachment device is preferably located in the middle of the second surface of the plate. To provide ease of use, the stick attachment device should be configured to allow the stick 20 to pivot freely in two-dimensions relative to the plate. 12. As those skilled in the art will appreciate, any conventional attachment device that will allow the stick 20 to pivot relative to the plate 12 may be employed. Preferably, the stick attachment device includes a stick receiver 22 to receive the stick at a first end 24. At the stick receiver's second end 26, the stick receiver 22 connects with a universal joint 28 which is in turn, is connected to the second surface 16. Alternatively, the stick receiver 22 may have a ball at its second end 26. A socket (not depicted) configured to receive the ball is then connected on the second surface 16. In either embodiment, the stick receiver 22 at the first end 24 is preferably configured to threadedly receive the stick 20.

To attach a conventional broom brush 30 to the plate 12, a broom brush attachment device is connected to the second surface 16. Preferably to allow the brush 30 bristles 32 to extend beyond the plate 12, the broom brush attachment device is connected to the second surface 16 adjacent an edge of the plate 12. The broom brush attachment device includes a brush receiver to receive the broom brush 30 and a brush receiver connector connected to the second surface 16 and to the brush receiver. The brush receiver is preferably a threaded plug 34 having a first 36 and a second end 38; the first end 36 is configured to thread into the broom brush 30. The brush receiver connector is preferably a collar 40 configured to threadedly connect to the second end 38 of the plug 34.

To lock the stick 20 to the plate 12, a locking device is connected to the second 16 surface. Preferably, the locking device is situated on the other end of the plate 12 away from the broom brush attachment device and is linearly aligned with the stick attachment device. Preferably, the locking device is a flexible c-clamp 42 configured to receive the stick 20.

Figure 4:
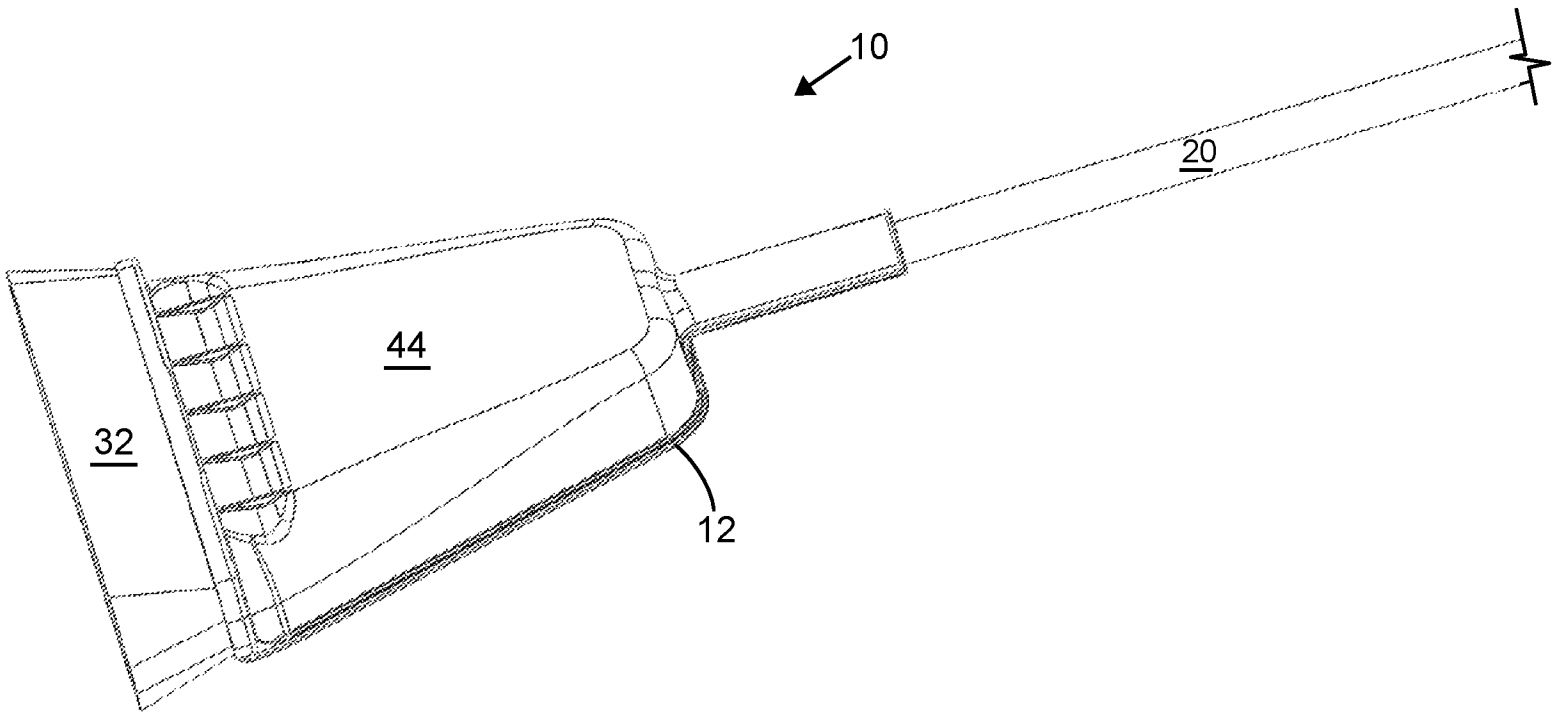
FIG. 4 is a perspective view of the invention of FIG. 1 with an optionally attached dust pan.

As shown in FIG. 4, optionally, the adapter apparatus 10 may also include a dust pan 44 shaped to cover the plate and is configured to attach to the stick 20.

Operation

To utilize the apparatus 10, a user simply dismantles a conventional broom or mop by unscrewing the stick 20 off of the broom or mop head. Taking the stick 20, the user simply inserts and threads the stick into stick receiver 22 at the first end 24. To connect the broom brush 30 to the plate 12, the user then inserts the first end 36 of the plug 34 into the broom brush (where the stick 20 was previously threadedly attached) and threads the plug into the broom brush. Plug 34 is then threaded at its second end 38 into collar 40. The fabric is positioned onto the first surface 14 by pushing it through the grippers 18. Preferably, the fabric is positioned to lie flat against the first surface 14.

To utilize the broom, the user preferably locks the stick 20 to the plate 12 by aligning and bringing the stick into c-clamp 42. Now the stick 20 and plate 12 can be used as a unified single unit to sweep a floor. Once sweeping is complete, rather than reaching for a separate mop, the user simply unlocks the stick 20 from the c-clamp 42 and contacts the fabric on first surface 14 onto the floor. Advantageously, the stick 20, given that the stick attachment device allows for a range of motions, can now maneuver the plate 12 around the floor in a multitude of directions to properly clean the floor.

While embodiments of the invention have been described and illustrated, such embodiments should be considered illustrative of the invention only. The invention may include variants not described or illustrated herein in detail. Thus, the embodiments described and illustrated herein should not be considered to limit the invention as construed in accordance with the accompanying claims.

What is claimed is:

1. A combination broom and cleaning fabric adapter apparatus comprising:

a planar plate having a first and a second surface, said plate being configured to position a cleaning fabric on said first surface;

stick attachment means connected to said second surface for attaching a broom stick or mop stick to said planar plate at a first location on said planar plate, said attachment means being configured to allow the stick to pivot freely in two-dimensions relative to said planar plate;

broom brush attachment means connected to said second surface adjacent an edge of said planar plate for attaching a broom brush to said planar plate; and locking means connected to said second surface at a second location on said plate member and in linear alignment with said stick attachment means for locking the stick to said planar plate.

2. The adapter apparatus of claim 1 wherein said stick attachment means comprises a stick receiver to receive said stick at a first end and a socket connected to said second surface, said stick receiver having a ball joint at a second end, said ball joint being configured to fit into said socket.

3. The adapter apparatus of claim 2 wherein said stick receiver at said first end is configured to threadedly receive the stick.

4. The adapter apparatus of claim 1 wherein said stick attachment means comprises a stick receiver to receive said stick at a first end and a universal joint connected to said second surface, said universal joint configured to attach with a second end of said stick receiver.

5. The adapter apparatus of claim 4 wherein said stick receiver at said first end is configured to threadedly receive the stick.

6. The adapter apparatus of claim 1 wherein said broom brush attachment means comprises a brush receiver to receive the broom brush and a brush receiver connector connected to said second surface and to said brush receiver.

7. The adapter apparatus of claim 1 wherein said locking means comprises a flexible c-clamp configured to receive the stick.

8. The adapter apparatus of claim 1 wherein said first surface comprises grippers to grip the cleaning fabric onto said first surface.

9. The adapter apparatus of claim 8 wherein said grippers comprises at least one Velcro™ strip.

10. A combination broom and cleaning fabric adapter apparatus comprising:

a planer plate having a first and a second surface, said plate being configured to position a cleaning fabric on said first surface;

stick attachment means connected to said second surface for attaching a broom stick or mop stick to said planar plate at a first location on said planar plate, said attachment means being configured to allow the stick to pivot freely in two-dimensions to said planar plate; and broom brush attachment means connected to said second surface adjacent an edge of said planar plate for attaching a broom brush to said planar plate, said broom brush attachment means comprising a brush receiver to receive the broom brush and a brush receiver connector connected to said second surface and to said brush receiver, said brush receiver comprising a threaded plug having a first and second end, said first end being configured to thread into the broom brush.

11. The adapter apparatus of claim 10 wherein said brush receiver connector is configured to threadedly connect to said second end of said threaded plug.

12. The adapter apparatus of claim 10 wherein said brush receiver connector comprises a collar.

13. A combination broom and cleaning fabric adapter apparatus comprising:

a planar plate having a first and second surface, said plate being configured to position a cleaning fabric on said surface;

stick attachment means connected to said second surface for attaching a broom stick or mop stick to said planar plate at a first location on said planar plate, said attachment means being configured to allow the stick to pivot freely in two-dimensions relative to said planar plate;

broom brush attachment means connected to said second surface adjacent an edge of said planar plate for attaching a broom brush to said planar plate; and a dust pan shaped to cover said planar plate and configured to attach to the stick.

* * * * *